United States Patent [19]

Schoenmeyr

[11] Patent Number: 4,507,058

[45] Date of Patent: Mar. 26, 1985

[54] WOBBLE PLATE PUMP AND DRIVE MECHANISM THEREFOR

[75] Inventor: Ivar L. Schoenmeyr, Mission Viejo, Calif.

[73] Assignee: Carr-Griff, Inc., Fullerton, Calif.

[21] Appl. No.: 565,027

[22] Filed: Dec. 20, 1983

[51] Int. Cl.[3] ..... F04B 1/06; F04B 1/18

[52] U.S. Cl. ..... 417/270; 417/271; 92/12.2

[58] Field of Search ..... 417/269, 270, 222; 92/12.2

[56] References Cited

U.S. PATENT DOCUMENTS

| | | | |
|---|---|---|---|
| 2,573,863 | 11/1951 | Mitchell | 417/270 |
| 3,010,403 | 11/1961 | Zubaty | 417/269 |
| 4,153,391 | 5/1979 | Hartley | 417/566 |

FOREIGN PATENT DOCUMENTS

| | | | |
|---|---|---|---|
| 65938 | 12/1982 | European Pat. Off. | 417/269 |
| 496665 | 3/1930 | Fed. Rep. of Germany | 417/269 |
| 932763 | 8/1955 | Fed. Rep. of Germany | 417/269 |
| 21043 | 4/1956 | Fed. Rep. of Germany | 417/269 |
| 585940 | 11/1958 | Italy | 417/270 |
| 468122 | 6/1937 | United Kingdom | 417/270 |

*Primary Examiner*—William L. Freeh

*Attorney, Agent, or Firm*—Gordon L. Peterson

[57] ABSTRACT

An apparatus for moving a fluid medium comprising a positive displacement member movable to move the fluid medium and a drive mechanism adapted to be driven by a motor for driving the positive displacement member to move the fluid medium. The drive mechanism includes a wobble plate coupled to the positive displacement member for driving the positive displacement member. The drive mechanism is responsive to back pressure on the positive displacement member for adjusting the angle of the wobble plate to thereby change the volume of the fluid medium movable by the positive displacement member.

19 Claims, 14 Drawing Figures

Fig. 2
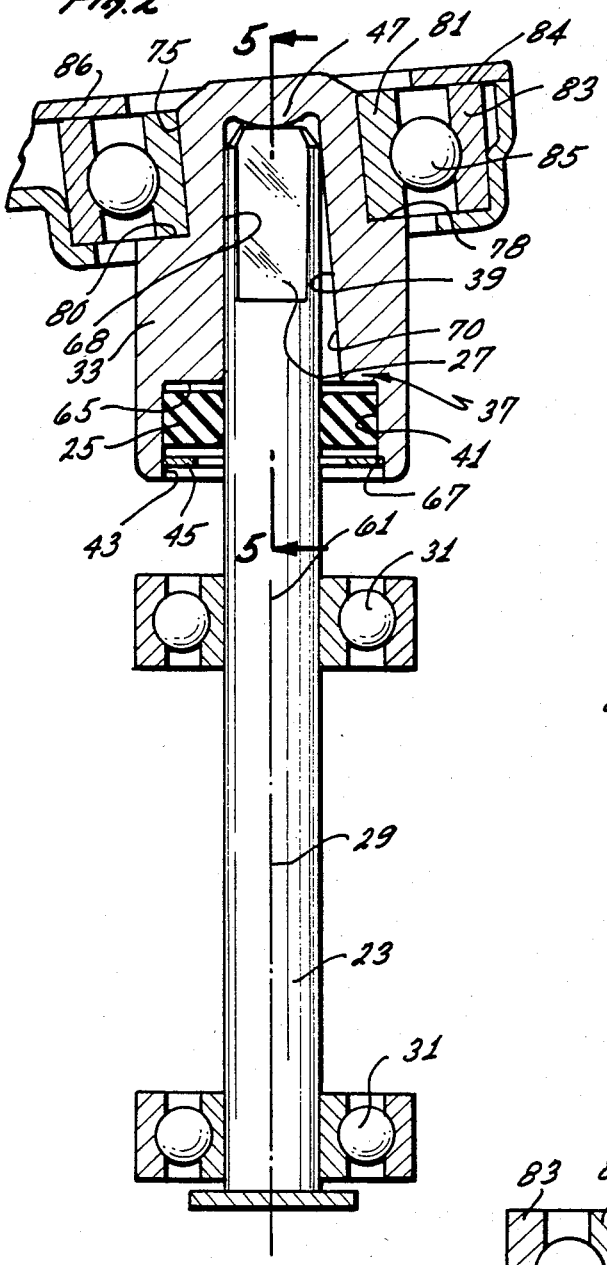
Fig. 3
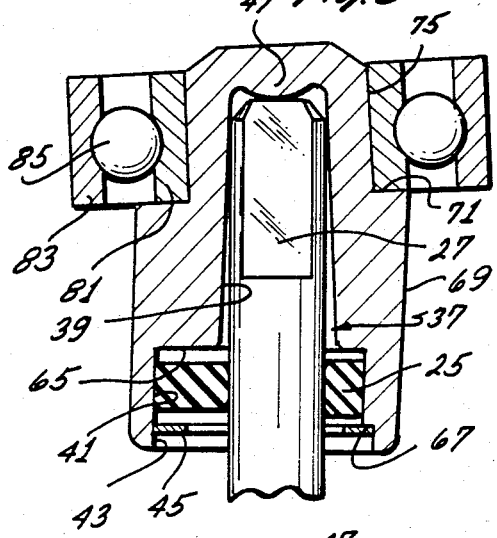
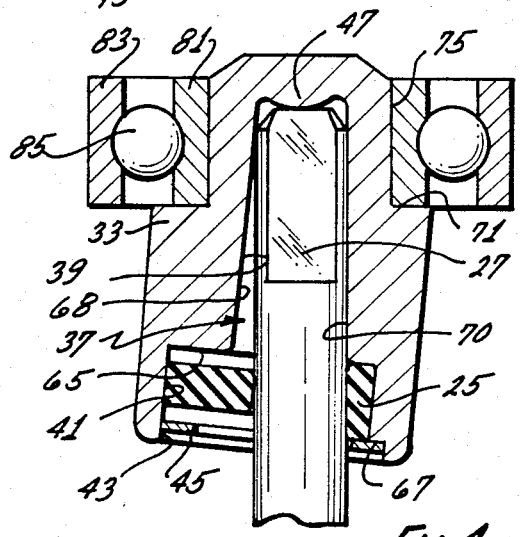
Fig. 4
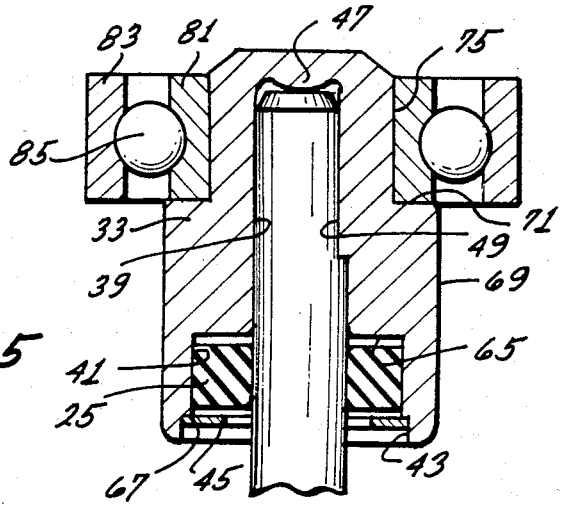
Fig. 5

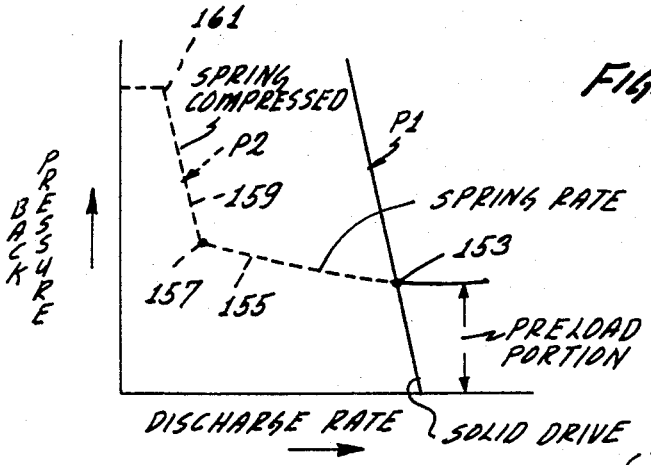
Fig. 10
Fig. 11
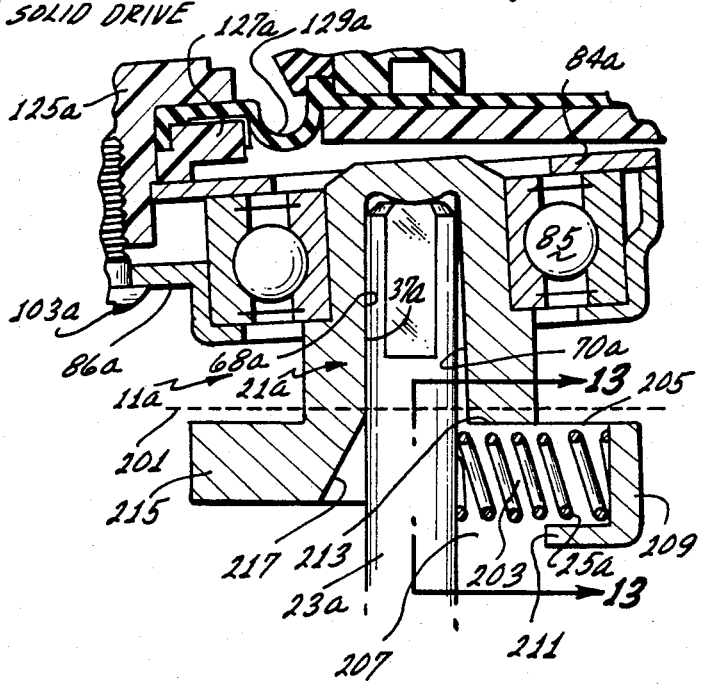
Fig. 13
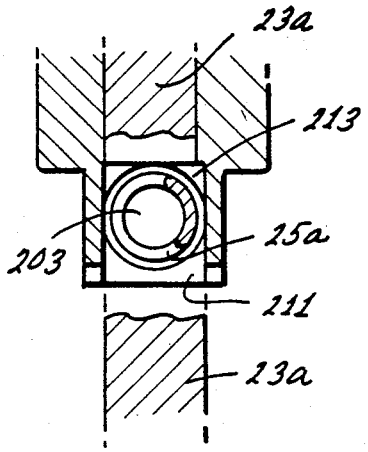
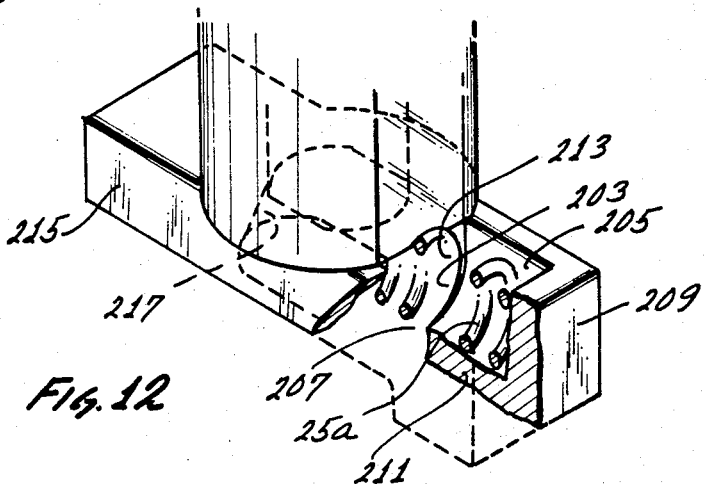
Fig. 12

WOBBLE PLATE PUMP AND DRIVE MECHANISM THEREFOR

BACKGROUND OF THE INVENTION

Positive displacement pumps, such as piston pumps and diaphragm pumps, typically displace an essentially constant volume of liquid with each stroke of the positive displacement pumping member. Pumps of this type are very useful for many applications, and a typical positive displacement pump is shown by way of example in Hartley U.S. Pat. No. 4,153,391.

For some applications and under some operating conditions, the characteristic of positive displacement pumps which causes them to displace a constant volume of liquid per stroke is undesirable. For example, when a positive displacement pump is used to supply a liquid for which there is a low demand relative to the output of the pump, the pump must operate under substantial back pressure unless some means is provided to correct this condition. A high back pressure tends to provide a heavy load on the motor for the pump.

One way to attempt to correct this is to cycle the pump on and off in response to demand as is commonly done in water supply systems for recreational vehicles. Unfortunately, the pump and motor may be cycled many times in order to meet the requirements of low liquid demand. A second approach is to bypass the excess liquid, but this requires that the motor and pump operate at maximum speed while producing only a very low effective output. Finally, in certain wobble plate pumps, the angle of the wobble plate can be manually adjusted with appropriate tools to vary the stroke and, hence, the output of the pump. However, manual changes of this type require a relatively long time to make and, therefore, they cannot be made in response to rapidly fluctuating liquid demand.

SUMMARY OF THE INVENTION

This invention solves these problems by providing a positive displacement pump with a variable output. This is accomplished automatically in response to back pressure on the positive displacement member. With this invention, the displacement of the pump is varied in a novel and advantageous way.

The drive means for the pump includes a wobble plate coupled to the positive displacement member for driving the positive displacement member. The angle of the wobble plate, i.e., the angular displacement of the wobble plate from a radial plane, controls the length of stroke of the positive displacement member and the volume pumped, With this invention, the angle of the wobble plate is adjusted automatically in response to the back pressure on the positive displacement member to thereby change the volume of the fluid medium movable by the positive displacement member.

In order to adjust the angle of the wobble plate, the wobble plate must be mounted for pivotal movement. This can be advantageously accomplished by utilizing a coupler and a shaft in the drive train between the motor for the pump and the wobble plate. The coupler has a bore for rockably receiving the shaft whereby the angle of the wobble plate can be varied. The bore is oversized relative to the shaft on the high side of the wobble plate so that the wobble plate angle can be reduced by relative pivoting movement of the coupler and the shaft. Although the wobble plate can be mounted on either the shaft or the coupler, preferably, it is mounted on the coupler, and the shaft may be the motor shaft or another shaft driven by the motor.

In order to transmit rotary input motion from an input member to the positive displacement member, the wobble plate angle must be greater than zero. In other words, the wobble plate must be inclined or tilted about a transverse axis relative to a radial plane. When the wobble plate angle is varied in accordance with the principles of this invention, the wobble plate is pivoted about that same transverse axis to establish a new wobble plate angle.

As applied to pumps, the positive displacement member is moved by the wobble plate drive mechanism through intake and discharge strokes. During the discharge stroke, the pressure in the pumping chamber in which the positive displacement pumping member is located, increases to outlet pressure. The pressure in the pumping chamber during the discharge stroke is a function of downstream pressure and is, therefore, the back pressure which brings about a change in the wobble plate angle. Specifically, when the pressure in the pumping chamber or the back pressure increases, the wobble plate angle decreases to thereby shorten the stroke of the positive displacement member and reduce the output from the pumping chamber.

The pressure within a pumping chamber is not constant and varies from vacuum pressures during intake to relatively high positive pressure during discharge. Although the vacuum pressure during the intake stroke also tends to reduce the wobble plate angle, it is primarily the pressure in the pumping chamber during the discharge stroke that influences the wobble plate angle.

The angle of the wobble plate can be accurately and inexpensively automatically varied by employing resilient means for urging the wobble plate in a direction to oppose the back pressure. The resilient means preferably acts between the coupler and the shaft. For example, the resilient means may include a coil spring or an annular seal member. The resilient means also resists axial separation of the coupler and the shaft, and this is particularly useful on the suction stroke during which vacuum pressure in the pumping chamber can exert an axial force tending to separate the shaft and the coupler.

To drivingly couple the coupler and the shaft, confronting surfaces of these members are preferably flat. These flat driving surfaces are preferred because they permit the shaft and the coupler to remain in driving engagement throughout the full range of tilting motion referred to above. To maintain a wide area of surface contact between these flat surfaces, preferably the flat surface of the coupler widens as it extends axially. The plane of these flat surfaces should be parallel to the plane in which the wobble plate pivots to adjust the angle of the wobble plate.

The angle of the wobble plate can be adjusted to vary the stroke from 100 percent, i.e., full stroke, down to any desired stroke, including zero. Preferably, the stroke adjustment is from 100 percent down to some minimum stroke greater than zero. However, if the stroke adjustment does go down to zero, the pump may automatically be shut off by a pressure switch or other suitable pressure sensing device before the back pressure reaches a magnitude that would produce a zero stroke, and hence, a zero output.

Although this invention is particularly adapted to a pump, it should be understood that the work "pump" as used herein means any apparatus, including compressors, for moving a fluid medium whether that medium contains liquid, gas, extrudable material, solids, or any combination of these. Furthermore, the wobble plate drive mechanism of this invention can be used in any combination in which a wobble plate can be used to transmit motion from a driving member to a driven member.

The invention, together with additional features and advantages thereof, may best be understood by reference to the following description taken in connection with the accompanying illustrative drawing.

BRIEF DESCRIPTION OF THE DRAWINGS

FIGS. 2–4 are fragmentary elevational views of a portion of the wobble plate drive mechanism illustrating how the angle of the wobble plate changes in response to back pressure.

FIG. 5 is a fragmentary sectional view taken generally along line 5—5 of FIG. 2.

FIG. 10 is a plot of back pressure versus flow rate for a conventional positive displacement pump and the pump of this invention.

FIG. 11 is a fragmentary axial sectional view showing a second embodiment of the invention.

FIG. 12 is a perspective view of the coupler with portions broken away.

FIG. 13 is a sectional view taken generally along line 13—13 of FIG. 11.

DESCRIPTION OF THE PREFERRED EMBODIMENT

Figure 1:
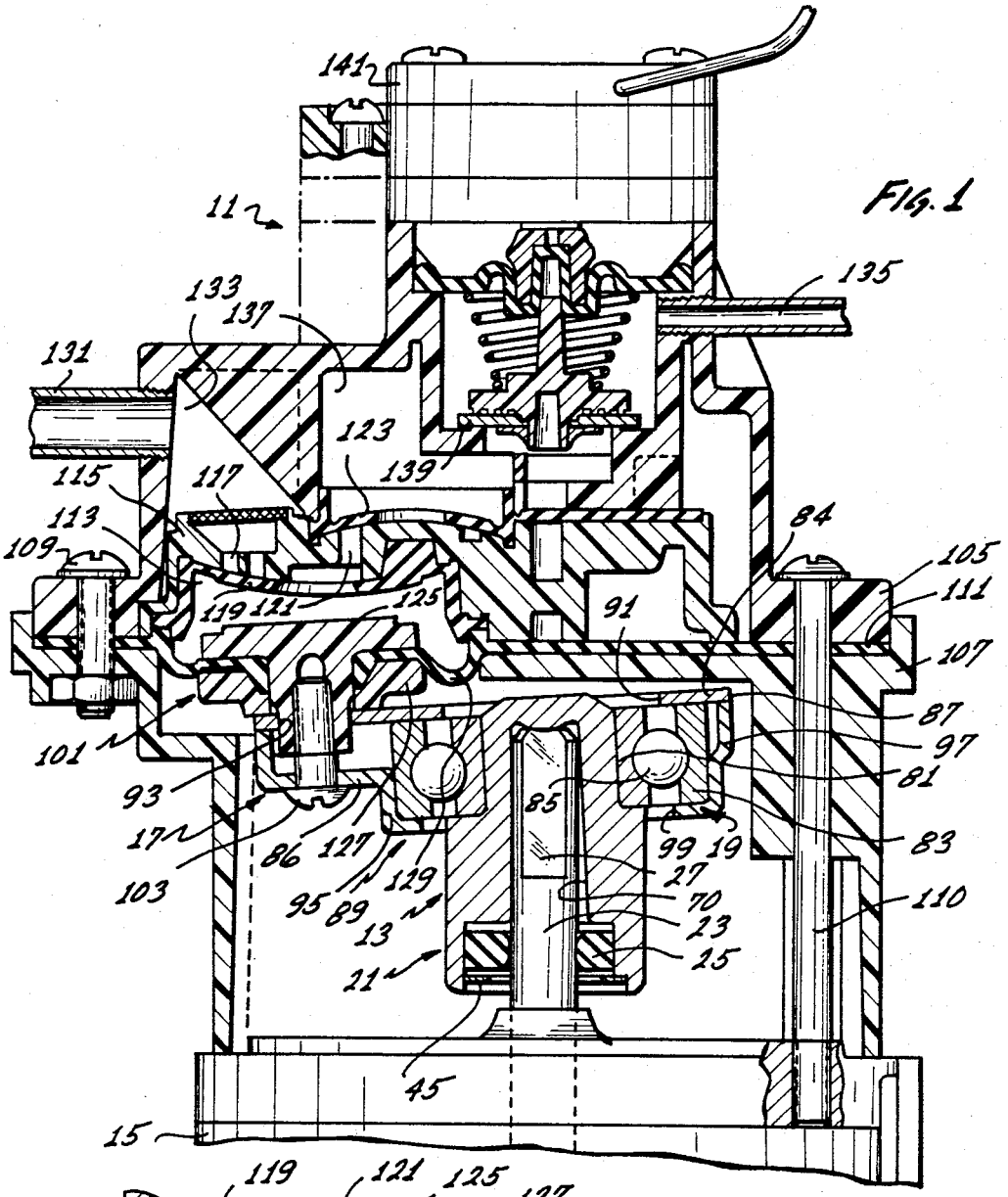
FIG. 1 is an elevational view partly in section of a pump having the wobble plate drive mechanism of this invention incorporated therein.

FIG. 1 shows a pump 11 having incorporated therein a wobble plate drive mechanism 13 constructed in accordance with the teachings of this invention. The drive mechanism 13 can be employed with pumps other than the pump 11 and with devices which are not pumps. The pump 11 is driven by an electric motor 15, and power from the motor is transmitted to the pump via the drive mechanism 13. Generally, the drive mechanism 13 includes a wobble plate 17, a bearing 19, a coupler 21, a rotatably shaft 23 and resilient means in the form of an annular resilient seal member 25.

Although the position of the coupler 21 and the shaft 23 could be reversed, in the embodiment illustrated, the shaft 23 forms the power input member to the drive mechanism 13. In the embodiment illustrated, the shaft 23 is the output shaft from the motor 15, although this is not necessary in that the shaft 23 can be driven indirectly by the motor 15 or another power source, if desired. The shaft 23 has a flat surface 27 adjacent its outer end. The shaft 23 is supported for rotation about its longitudinal shaft axis 29 by bearings 31 which are bearings of the motor 15 (FIG. 2). The shaft 23 may also be supported by a thrust bearing (not shown).

The coupler 21 is a somewhat elongated, generally cup-shaped member which is preferably cast from a suitable metal, such as aluminum or injection molded using an appropriate plastic material. The coupler 21, in the configuration illustrated, has a peripheral wall 33 (FIGS. 6–9), an end wall 35 and a bore 37 extending axially from the end wall 35 to the other end of the coupler. The bore 37 is stepped and has an elongated inner driving portion 39, an enlarged portion 41 for receiving the seal member 25, and a further enlarged outer portion 43 for receiving a retaining ring 45 (FIG. 1) for retaining the seal. The end wall 35 has a convex surface forming a projection in the form of a dimple 47 which projects axially into the driving portion 39. The dimple 47 is preferably part cylindrical or part spherical. The driving portion 39 also has a flat surface 49 which extends from the inner end of the driving portion 39 toward the open end of the bore 37, and it is adapted to cooperate with the flat surface 27 of the shaft 23 so that the shaft can rotate the coupler 21.

Figure 9:
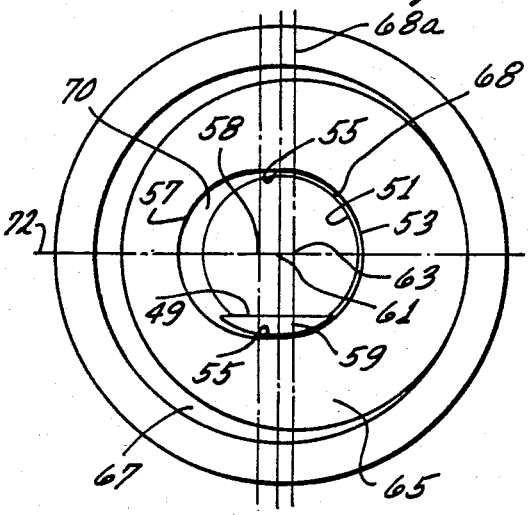

As shown in FIG. 9, the driving portion 39 at its inner end has a circular outline 51, except for the flat surface 49. At the outermost end of the driving portion 39, the driving portion is defined by a semi-circular outline 53, opposed flats 55 which are parallel to the flat surface 49 and a part-circular outline 57 having a radius equal to the semi-circular outline 53 and a center 58. The flat surface 49 progressively widens as it extends outwardly, and it terminates in a radial surface 59 spaced from the outer end of the driving portion 39.

The circular outlines 51 and 53 have a center or axis 61, and the enlarged portion 41 has a center or axis 63 displaced somewhat from the axis 61. Also as shown in FIG. 9, the enlarged portion 41 meets the driving portion 39 in an annular shoulder 65 of varying radial dimension, and the outer portion 43 meets the enlarged portion 41 in a shoulder 67 which is of varying radial dimension and which extends for slightly less than 360 degrees.

The driving portion 39 progressively widens as it extends outwardly away from the end wall 35. However, the progressive widening is not merely a general enlarging of the cross section, but rather, the progressive widening is controlled so as to permit the coupler 21 to pivot or tilt from the position shown in FIG. 2 through the position of FIG. 3 to the position of FIG. 4. To best accomplish this, the driving portion 39 has a part-cylindrical surface 68 having the circular outlines 51 and 53 at its upper and lower ends, respectively, and lying generally to the right of a radial line 68*a* (FIG. 9) extending through the axis 63. The cylindrical nature of the surface 68 is interrupted by a portion of the flat surface 49 and by a gentle draft angle of a magnitude commonly employed to facilitate withdrawal of the coupler 21 from its mold during manufacture. The draft angle is manifest in FIG. 9 where it can be seen that the diameter of the circular outline 53 is slightly larger than the diameter of the circular outline 51. The part-cylindrical surface 68 is such that it can receive a cylindrical shaft, such as the shaft 23 of the motor 15.

The widening of the driving portion 39 is provided by a part-conical surface 70 which extends between the circular outline 51 at the inner end of the driving portion to the larger diameter circular outline 57 at the outer end of the driving portion. This conical surface generally lies to the left of the flats 55 as shown in FIG. 9 and is interrupted by a portion of the flat surface 49. Thus, the driving portion 39 widens in the direction of a radial axis 72 (FIG. 9) which is parallel to the flat surface 49. More specifically, the widening occurs only in one direction along the radial axis 72, i.e., to the left as viewed in FIG. 9, and any other widening is solely the result of draft angle for molding purposes.

The peripheral wall 33 has a generally cylindrical section 69 having for its center the axis 63 and an annular shoulder 71 between the cylindrical section 69 and an eccentric hub 73. The hub 73 has a peripheral surface 75 which has a center or axis 77 which is inclined relative to the axes 61 and 63 which are parallel. The peripheral surface 75 is generally cylindrical, except for a series of longitudinally extending, alternately tapering splines 79 which define tapering, generally axially extending recesses or grooves 76 which provide space for the cold flow of material from the coupler and the bearing 19 when the bearing 19 is pressed onto the peripheral surface 75. The shoulder 71 is in a plane perpendicular to the axis 77, and thus the shoulder 71 is inclined relative to the axes 61 and 63 to provide the shoulder with a high side 78 and a low side 80. The highest point of the high side 78 and the lowest point of the low side 80 lie along the axis 72 with the high side generally being on the same side as the part conical surface 70.

As shown in FIGS. 1 and 2, the bore 37 receives the outer end of the shaft 23 with the flat surfaces 27 and 49 being in confronting driving relationship and with the dimple 47 contacting the outer end of the shaft to define an axis about with the coupling 21 and shaft 23 can relatively tilt. In the position shown in FIG. 2, the axes 29 and 61 are coincident and the cylindrical peripheral surface of the shaft engages the part-cylindrical surface 68. The part conical surface 70 of the coupler 21 is spaced from the shaft 23 to allow the coupler to pivot counterclockwise as viewed in FIG. 2.

Although the bearing 19 can be of various different constructions, in the embodiment illustrated, it is a ball bearing which includes an inner race 81, an outer race 83 and a series of balls 85 between the races. The inner race 81 is drivingly coupled to the coupler 21 by a press fit.

The bearing 19 rests on the shoulder 71 and accordingly, is inclined relative to, and defines an acute angle with, the axis 29 of the shaft 23. Similarly, the wobble plate 17 is inclined relative to the axis 29 and its inclination from a radial plane constitutes a wobble plate angle. The wobble plate 17 has a high side 84 and a low side 86 (FIG. 2) on, and coextensive with, the high side 78 and the low side 80, respectively, of the coupler 21.

The wobble plate 17 can be of various different constructions and, in the embodiment illustrated, it includes a plate 87 and a shallow cup 89. The plate 87, the cup 89 and the fluid moving portions of the pump 11 may be constructed in accordance with common assignee's co-pending application Ser. No. 251,343 filed on Apr. 6, 1981, the disclosure of which is incorporated by reference herein. The plate 87 and the cup 89 may be constructed of sheet material, such as steel, and the plate 87 may be flat and triangular and have a central circular opening 91 and three equally spaced non-circular openings 93.

The cup 89 receives the bearing 19 and includes a shallow dish section 95 for receiving the outer race 83 and a continuous flange 97. The dish section 95 has a central opening 99 so that the inner race 81 is not contacted by the cup 89. The cup 89 is generally triangular and co-extensive with the triangular configuration of the plate 87 as viewed in a plane taken generally radially in FIG. 1.

The plate 87 and the cup 89 are drivingly coupled to a positive displacement pumping member 101 by a screw 103 which extends through an opening in the cup 89 and one of the openings 93 of the plate 87. This connection also holds the wobble plate 17 against rotation. Of course, the wobble plate 17 can be used to drive driven members other than the pumping member 101.

The wobble plate 17 can be used to drive different kinds of pumps, and the pump construction illustrated is merely illustrative. The fluid moving portions of the pump may be identical with the pump disclosed in Hartley U.S. Pat. No. 4,153,391, which is incorporated by reference herein, and for that reason, the fluid moving portions of the pump are not described in complete detail herein.

Briefly, the pump 11 includes housing sections 105 and 107 held together by aplurality of fasteners 109 and having a diaphragm 111 sandwiched between them. The ousing sections 105 and 107 are attached to the motor 15 in any suitable way, such as by screws 110 (only one being shown in FIG. 1.) The pumping member 101, which includes a movable region 112 of the diaphragm, and an insert 115 define a pumping chamber 113. The insert 115 has inlet openings 117, an inlet check valve 119 normally covering the inlet openings 117, an outlet opening 121 and an outlet check valve 123. A section of the diaphragm 111 is clamped between clamps 125 and 127 and the screw 103 holds the clamping members tightly together and drivingly couples the wobble plate 17 to the clamping members and the region 112 of the diaphragm 111. An annular fold 129 in the diaphram 111 allows some radial displacement of the region 112 of the diaphragm 111. Although only one pumping member 101 and pumping chamber 113 are shown in FIG. 1, the pump 11 has three identical pumping members 101 and chambers 113, with the pumping members 101 drivingly coupled to the three corners, respectively, of the wobble plate 17 in accordance with Hartley U.S. Pat. No. 4,153,391.

The pump has an inlet 131 leading to an inlet chamber 133 which ommunicates with the pumping chambers 113 by way of the inlet openings 117 as permitted by the inlet check valves 119 of each of the pumping chambers. The pump 11 also has an outlet 135, and each of the pumping chambers 113 communicates with the outlet by way of the outlet openings 121, an outlet chamber 137 and a spring biased outlet valve 139. The motor 15 is cycled on and off by a pressure switch 141 in response to fluid pressure at the outlet 135.

In use, a drop in the pressure at the outlet 135 causes the pressure switch 141 to energize the motor 15 in a conventional manner. Rotation of the shaft 23 about its axis 29 rotates the coupler 21 and the inner race 81 of the bearing 19. Because the bearing 19 and the wobble plate 17 are inclined relative to a radial plane and because the wobble plate is held against rotation, rotation of the coupler 21 causes nutation of the wobble plate, and this in turn causes reciprocation of each of the positive displacement pumping members 101.

On the intake stroke of the pumping member 101 shown in FIG. 1, this pumping member moves downwardly (as viewed in FIG. 1) to draw water from the inlet 131 into the pumping chamber 113. On the discharge stroke, the pumping member 101 moves upwardly as viewed in FIG. 1 to force water from the pumping chamber 113 through the outlet opening 121 and the outlet valve 139 to the outlet 135 as described more fully in U.S. Pat. No. 4,153,391 referred to above. Each of the three pumping members 101 is repeatedly moved through intake and discharge strokes in this same manner with each of the pumping members being 120° out of phase with the others.

As pressure at the outlet 135 increases, pressure in the pumping chambers 113 on the discharge stroke also increases. This back pressure resists the discharge stroke of the pumping members 101, and this tends to pivot the coupler 21 clockwise as permitted by the oversized driving portion 39 of the bore 37 from the position shown in FIGS. 1 and 2 to the position shown in FIG. 3 against the biasing action of the resilient seal member 25. In FIGS. 1 and 2 the part cylindrical surface 68 engages the shaft 23 to define a maximum wobble plate angle. The seal member 25 is preloaded between the shaft 23 and the coupler 21, and the coupler does not begin to pivot until the back pressure is sufficient to overcome the preload. After the preload is overcome, the spring rate of the seal member 25 controls the magnitude of the force required to pivot the coupler 21 a predetermined increment. Such clockwise pivotal motion of the coupler 21 reduces the wobble plate angle, i.e., moves the wobble plate toward a true radial plane, to thereby reduce the length of the stroke of the pumping member 101. With an increase in back pressure, the coupler 21 can pivot farther to the position shown in FIG. 4 which brings about a further shortening of stroke of the pumping member 101 and decrease in the output from the pumping chamber 113. In FIG. 4, the coupler 21 has pivoted to bring the part conical surface against the shaft 23 to thereby define the minimum wobble plate angle.

Figure 1A:
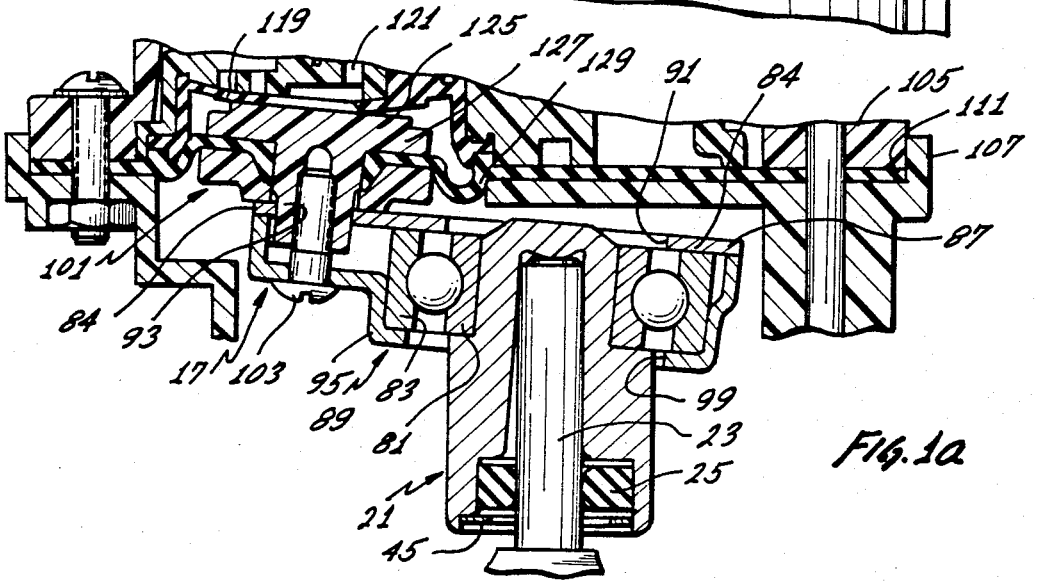
FIG. 1*a* is a fragmentary sectional fiew of a portion of FIG. 1 with the coupler rotated 180° and the pumping member at the end of its discharge stroke.
Figure 6:
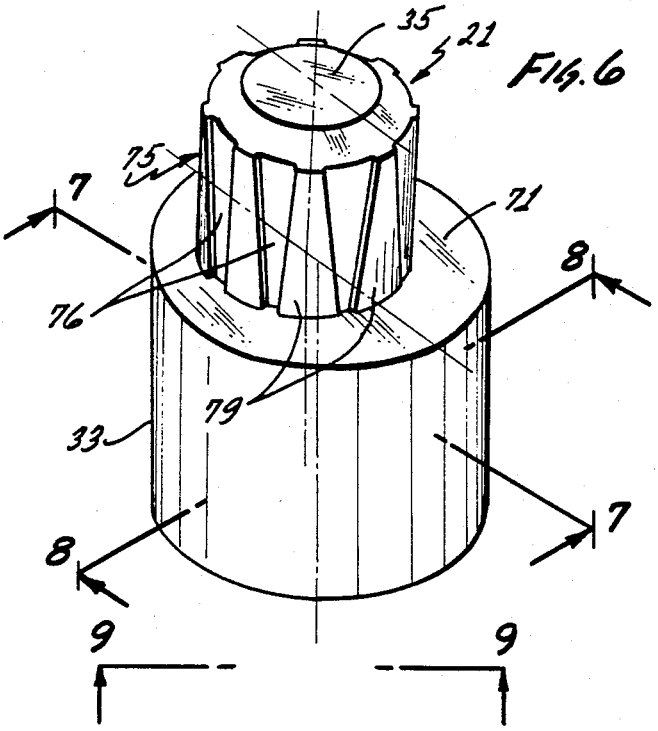
FIG. 6 is an isometric view of the coupler.
Figure 7:
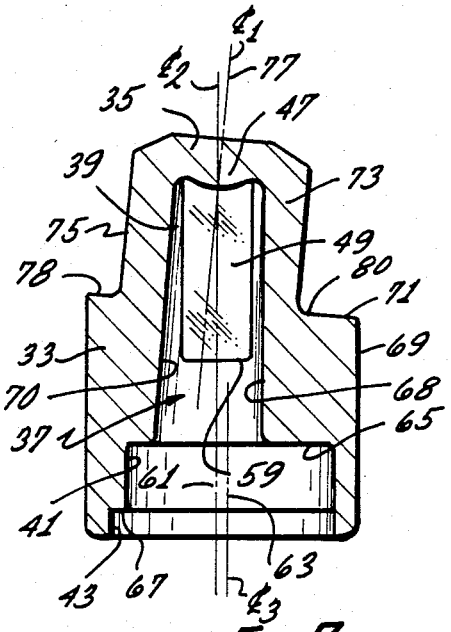
FIGS. 7, 8 and 9 are views taken generally along lines 7—7, 8—8 and 9—9, respectively, of FIG. 6.
Figure 8:
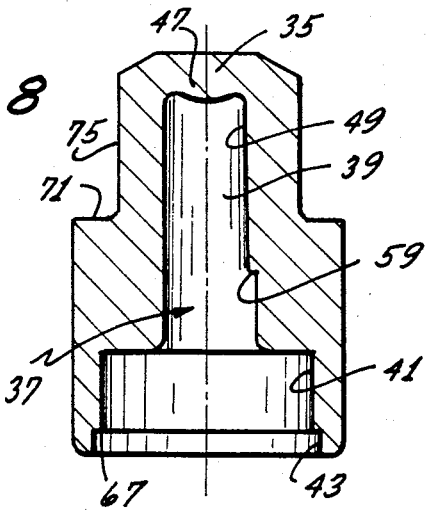

More specifically, the nutating motion of the wobble plate 17 brings about continuous rotation of the high side 84 and the low side 86 of the wobble plate. The pumping member 101 shown in FIG. 1 is moved on an intake stroke as a result of the coupler 21 rotating 180 degrees from the position of FIG. 1*a* to the position of FIG. 1 to move the low side 86 of the wobble plate to the position shown in FIG. 1. Thereafter, rotation of the coupler 21 through 180 degrees moves the high side 84 of the wobble plate 17 through 180 degrees to the position of FIG. 1*a* to thereby force the pumping member 101 shown in FIG. 1 through its discharge stroke. During the discharge stroke, the pressure in the pumping chamber 113 shown in FIG. 1 increases, and this tends to pivot the coupler 21 on the shaft 23 against the biasing force of the seal 25 as permitted by the part-conical surface 70. Of course, the part-conical surface 70 rotates with the coupler and is always properly positioned to accommodate pivotal motion of the coupler resulting from high pressure in the pumping chambers 113. Thus, regardless of the nunber of pumping chambers 113 that are employed, discharge pressure therein acts in the same manner described above to bring about pivoting movement of the coupler 21 against the biasing action of the seal 25 and as permitted by the part-conical surface 70 as a function of discharge pressure. The confronting flat surfaces 27 and 49 of the shaft and coupler, respectively, can slide relative to each other to permit this pivotal motion.

FIG. 10 shows a pump curve P1 for a standard positive displacement pump and pump curve P2 for the pump of this invention. As shown by the curve P1, the discharge rate from a conventional positive displacement pump reduces only slightly as back pressure increases.

The pump curve P2 for this invention has a preload portion 151 which extends to a point 153 at which the back pressure completely overcomes the preload of the seal member 25, and an output modifying portion 155 during which the wobble plate 17 and the coupler 21 are pivotable about the shaft 23 as described above to reduce the discharge rate as a function of increasing back pressure. The slope of the modifying portion 155 is a function of the spring rate of the seal member 25, and the modifying portion 155 terminates at a point 157 which corresponds to the position of the coupler 21 shown in FIG. 4 in which the coupler again bears firmly against the shaft 23.

The pump curve P2 has a portion 159 which represents a further increase in back pressure after the coupler 21 is pivoted a maximum allowable amount to the position of FIG. 4. Finally, if back pressure rises to a maximum allowable limit 161, the pressure switch 141 terminates operation of the pump.

The location of the preload portion 151 along the abscissa is a function of the maximum allowable wobble plate angle shown in FIG. 2. The portion 151 would be farther to the right for a larger maximum wobble plate angle and farther to the left for a reduced maximum wobble plate angle. Similarly, the point 157 is controlled by the minimum wobble plate angle shown in FIG. 4. If a higher discharge rate is desired at the point 157, a larger minimum wobble plate angle should be used.

FIGS. 11–13 show a pump 11*a* which is identical to the pump 11 in all respect not shown or described herein. Portions of the pump 11*a* corresponding to portions of the pump 11 are designated by corresponding reference numerals followed by the letter "a."

The only difference between the pumps 11 and 11*a* is that the latter employs a coil compression spring 25*a* in lieu of the seal member 25 as the resilient means and the coupler 21*a* is of a different configuration below reference line 201 in FIG. 11. The construction shown in FIGS. 11–13 is currently preferred because the spring rate of the spring 25*a* has less hysteresis than the spring rate of the seal member 25.

More specifically, the coupler 21*a* is modified in FIGS. 11–13 to accommodate the coil compression spring 25*a*. The coupler 21*a* has a transverse bore 203 which opens radially at contiguous locations along the axis of the transverse bore to define openings 205 and 207. The axis of the transverse 203 is generally perpendicular to the axis of the bore 37*a*.

The transverse bore 203 terminates outwardly in an end wall 209 which engages and supports the outer end of the spring 25*a*. The inner end of the spring 25*a* engages the shaft 23*a*. Intermediate its ends, the spring 25*a* is supported by half sections 211 and 213 which open in opposite axial directions at the openings 205 and 207, respectively. This construction adequately supports and guides the spring 25*a* and greatly facilitates casting of the coupler 21*a* as a single piece inasmuch as the openings 205 and 207 can be formed by oppositely directed inserts within the mold.

The coupler 21*a* has a counterbalance 215 on the opposite side of the shaft 23*a* from the spring 25*a* to essentially dynamically balance the coupler and spring combination. The bore 37*a* terminates outwardly in an inclined or part-conical loading surface 217. The transverse bore 23 extends across the bore 37*a* and terminates in the inclined or part-conical surface 217. The part-conical surface 217 facilitates insertion of the shaft 23*a* into the bore 37*a* to preload the spring 25*a*. This can be accomplished by inserting the shaft 23*a* along the surface 217 and then rotating the shaft and coupler 21*a* toward the position shown in FIG. 11 to preload the spring between the shat 23 and the end wall 209. When in position, the spring 25*a* resists axial separation of the coupler 21*a* and the shaft 23*a*. The pump 11*a* functions in the same manner as the pump 11, and the pump curve P2 is fully applicable to the operation of the pump 11*a*.

Although exemplary embodiments of the invention have been shown and described, many changes, modifications and substitutions may be made by one having ordinary skill in the art without necessarily departing from the spirit and scope of this invention.

I claim:

1. An apparatus for moving a fluid medium and adapted to be driven by a motor, said apparatus comprising:

a positive displacement member movable on intake and discharge strokes to move the fluid medium;

drive means adapted to be driven by the motor for driving the positive displacement member to move the fluid medium with the fluid medium exerting back pressure on the positive displacement member at least during the discharge stroke;

said drive means including a wobble plate coupled to the positive displacement member for driving the positive displacement member with the wobble plate having an angle which influences the length of said strokes and the volume of the fluid medium moved by the positive displacement member and means responsive to the back pressure on the positive displacement member for adjusting the angle of the wobble plate to change the volume of the fluid medium movable by the positive displacement member;

said back pressure responsive means includes a shaft having an end surface and a coupler having an end wall and a bore extending from said end wall to open at the exterior of the coupler, said bore being oversized relative to said shaft and receiving said shaft with the end surface engaging the end wall and cooperating therewith to define an axis about which the coupler and the shaft can relatively tilt; and said back pressure responsive means including resilient means for resiliently resisting the relative tilt of the shaft and the coupler in a direction to influence the angle of the wobble plate.

2. An apparatus as defined in claim 1 wherein said coupler has a surface defining a transverse bore which intersects said first mentioned bore and said resilient means includes a spring carried by said transverse bore.

3. An apparatus as defined in claim 1 wherein said shaft drives said coupler and said drive means includes means for drivingly coupling the coupler to the wobble plate.

4. An apparatus as defined in claim 1 wherein said bore is elongated and said resilient means acts against said shaft adjacent the end of said bore remote from the end wall.

5. An apparatus as defined in claim 1 wherein said bore is elongated and widens as it extends away from the end wall to allow the shaft and the coupler to relatively tilt.

6. An apparatus for moving a fluid medium and adapted to be driven by a motor, said apparatus comprising:

a positive displacement member movable on intake and discharge strokes to move the fluid medium;

drive means adapted to be drive by the motor for driving the positive displacement member to move the fluid medium with the fluid medium exerting back pressure on the positive displacement member at least during the discharge stroke;

said drive means including a wobble plate coupled to the positive displacement member for driving the positive displacement member with the wobble plate having an angle which influences the length of said strokes and the volume of the fluid medium moved by the positive displacement member and means responsive to the back pressure on the positive displacement member for adjusting the angle of the wobble plate to change the volume of the fluid medium movable by the positive displacement member; and the angle of the wobble plate providing the wobble plate with a high side and a low side whereby the wobble plate can drive the positive displacement member, said back pressure responsive means including a coupler and a shaft in the drive train between the motor and the wobble plate, and said coupler having a bore which is oversized relative to said shaft on the high side of the wobble plate for rockably receiving said shaft whereby the angle of the wobble plate can be varied.

7. An apparatus as defined in claim 6 wherein said bore widens as it extends axially outwardly, confronting surfaces of said shaft and said bore are flat with the flat surface of the bore being wider than the flat surface of the shaft whereby the flat surfaces can fully engage as the shaft and coupler rock relative to each other.

8. An apparatus as defined in claim 6 wherein said back pressure responsive means includes resilient means acting between the coupler and the shaft to bias the coupler and the shaft in a direction to increase the angle of the wobble plate.

9. An apparatus as defined in claim 8 wherein the wobble plate is pivotable in a first plane to adjust the wobble plate angle and the shaft and the bore have confronting drive surfaces which are generally in a plane which is generally parallel to said first plane.

10. An apparatus for moving a fluid medium and adapted to be driven by a motor, said apparatus comprising:

a positive displacement member movable on intake and discharge strokes to move the fluid medium;

drive means adapted to be driven by the motor for driving the positive displacement member to move the fluid medium with the fluid medium exerting back pressure on the positive displacement member at least during the discharge stroke;

said drive means including a wobble plate coupled to the positive displacement member for driving the positive displacement member with the wobble plate having an angle which influences the length of said strokes and the volume of the fluid medium moved by the positive displacement member and means responsive to the back pressure on the positive displacement member for adjusting the angle of the wobble plate to change the volume of the fluid medium movable by the positive displacement member;

said motor drives an input shaft, said back pressure responsive means including a coupler drivingly coupled to the wobble plate and having a bore for rockably receiving said shaft whereby the angle of the wobble plate can be varied;

said coupler has a surface defining a transverse bore which intersects said first-mentioned bore and said resilient means includes a spring carried by said transverse bore; and the spring being preloaded, the transverse bore extending across the first-mentioned bore and the surface defining the transverse bore terminating in a surface region which is inclined relative to the axis of said first-mentioned bore to facilitate loading of the shaft into the first-mentioned bore to preload said spring.

11. A drive mechanism as defined in claim 10 wherein said retaining means includes a driven member driven by said wobble plate.

12. A drive mechanism as defined in claim 10 wherein said resilient means is at least partially received in said other drive member and acts between said first and second drive members.

13. An apparatus for moving a fluid medium and adapted to be driven by a motor, said apparatus comprising:

a positive displacement member movable on intake and discharge strokes to move the fluid medium;

drive means adapted to be driven by the motor for driving the positive displacement member to move the fluid medium with the fluid medium exerting back pressure on the positive displacement member at least during the discharge stroke;

said drive means including a wobble plate coupled to the positive displacement member for driving the positive displacement member with the wobble plate having an angle which influences the length of said strokes and the volume of the fluid medium moved by the positive displacement member and means responsive to the back pressure on the positive displacement member for adjusting the angle of the wobble plate to change the volume of the fluid medium movable by the positive displacement member;

said motor drives an input shaft, said back pressure responsive means including a coupler drivingly coupled to the wobble plate and having a bore for rockably receiving said shaft whereby the angle of the wobble plate can be varied;

said coupler has a surface defining a transverse bore which intersects said first-mentioned bore and said resilient means includes a spring carried by said transverse bore; and said transverse bore opening radially at first and second locations along the transverse bore whereby said surface defining said transverse bore does not fully circumscribe any region along the length of the spring.

14. An apparatus for moving a fluid medium and adapted to be driven by a motor, said apparatus comprising:

a positive displacement member movable on intake and discharge strokes to move the fluid medium;

drive means adapted to be driven by the motor for driving the positive displacement member to move the fluid medium with the fluid medium exerting back pressure on the positive displacement member at least during the discharge stroke;

said drive means including a wobble plate coupled to the positive displacement member for driving the positive displacement member with the wobble plate having an angle which influences the length of said strokes and the volume of the fluid medium moved by the positive displacement member and means responsive to the back pressure on the positive displacement member for adjusting the angle of the wobble plate to change the volume of the fluid medium movable by the positive displacement member;

said motor drives an input shaft, said back pressure responsive means including a coupler drivingly coupled to the wobble plate and having a bore for rockably receiving said shaft whereby the angle of the wobble plate can be varied;

said coupler has a surface defining a transverse bore which intersects said first-mentioned bore and said resilient means includes a spring carried by said transverse bore; and said resilient means also resisting axial separation of the coupler and the input shaft.

15. An apparatus for moving a fluid medium and adapted to be driven by a motor, said apparatus comprising:

a positive displacement member movable on intake and discharge strokes to move the fluid medium;

drive means adapted to be driven by the motor for driving the positive displacement member to move the fluid medium with the fluid medium exerting back pressure on the positive displacement member at least during the discharge stroke;

said drive means including a wobble plate coupled to the positive displacement member for driving the positive displacement member with the wobble plate having an angle which influences the length of said strokes and the volume of the fluid medium moved by the positive displacement member and means responsive to the back pressure on the positive displacement member for adjusting the angle of the wobble plate to change the volume of the fluid medium movable by the positive displacement member;

said motor drives an input shaft, said back pressure responsive means including a couupler drivingly coupled to the wobble plate and having a bore for rockably receiving said shaft whereby the angle of the wobble plate can be varied; and the coupler having an exterior surface defining a plurality of recesses whereby space is provided for the cold flow of material when the coupler is pressed into another member.

16. A drive mechanism comprising:

a wobble plate;

means for retaining the wobble plate against rotation;

a first rotatable drive member, said wobble plate being mounted on said first rotatable drive member so that rotation of the first rotatable drive member causes the wobble plate to nutate;

a second rotatable drive member for driving said first rotatable drive member;

one of said drive members including a rotatable shaft and the other of said drive members having a wall and a bore in said wall for receiving said shaft;

the axis of the wobble plate being inclined whereby the wobble plate has a high side and a low side, said bore being oversized relative to said shaft in the plane extending between said sides whereby the angle of the wobble plate and the first drive member relative to the second drive member can change;

resilient means for urging the wobble plate and the first drive member in a direction relative to the second drive member to tend to influence the angle of the wobble plate; and said wall of said other drive member having a projection extending axially into the bore and said shaft having an end surface for engaging the projection to define an axis about which the drive members can relatively tilt.

17. An apparatus for moving a fluid medium and adapted to be driven by a motor, said apparatus comprising:

a positive displacement member movable to move the fluid medium;

a wobble plate drivingly coupled to said positive displacement member and substantially retained against rotation relative to the positive displacement member;

a coupler having a wall and a bore extending generally axially to the exterior of the coupler;

bearing means for mounting the wobble plate on the coupler so that the wobble plate is inclined relative to the axis of said bore whereby rotation of the coupler can produce nutating motion on the wobble plate; and said bore widening in the direction of inclination of the wobble plate as the bore extends axially.

18. An apparatus as defined in claim 17 including a resilient seal member received within an enlargement of said bore.

19. An apparatus as defined in claim 17 wherein said bore has an elongated flat surface extending generally axially of the bore and in said direction.

* * * * *